United States Patent [19]

Tury

[11] Patent Number: 4,929,369

[45] Date of Patent: May 29, 1990

[54] GREASE COMPOSITION

[75] Inventor: Bernard Tury, Prestwich, England

[73] Assignee: Imperial Chemical Industries PLC, London, United Kingdom

[21] Appl. No.: 417,335

[22] Filed: Oct. 5, 1989

[30] Foreign Application Priority Data

Oct. 26, 1988 [GB] United Kingdom ..... 8825073

[51] Int. Cl.[5] ..... C10M 129/50

[52] U.S. Cl. ..... 252/12; 252/28; 252/29; 252/42.1; 252/47

[58] Field of Search ..... 252/12, 28, 29, 42.1, 252/57

[56] References Cited

U.S. PATENT DOCUMENTS

| | | | |
|---|---|---|---|
| 2,197,832 | 4/1940 | Reiff | 252/38 |
| 2,223,129 | 11/1940 | Prutton | 252/41 |
| 2,330,239 | 9/1943 | Prutton | 252/38 |
| 3,870,643 | 2/1975 | Kerschner et al. | 252/56 R |
| 4,307,027 | 12/1981 | Borzelli et al. | 252/369 |
| 4,765,917 | 8/1988 | Otaki et al. | 252/42.1 |

*Primary Examiner*—Jacqueline V. Howard
*Attorney, Agent, or Firm*—William E. Dickheiser

[57] ABSTRACT

A composition which comprises (a) a salt of monovalent metal (M) of a carboxylic acid in which the COOH group is attached to a ring atom of a fused ring system and (b) a grease which is a non-soap thickened oil which may be a mineral oil or a synthetic oil such as a silicone oil. The metal (M) may be sodium. The fused ring system is preferably a fused aromatic hydrocarbon ring system such as naphthalene and may include further substituents, for example an -OH group, in addition to the COOH group. If the acid contains both OH and COOH groups, these can be attached to adjacent atoms of the fused ring system. Sodium 2-naphthoate and sodium 3-hydroxy-2-naphthoate have been found to be particularly suitable. The grease has improved corrosion resistance and the addition of the metal compound does not result in destructing of the grease.

15 Claims, No Drawings

GREASE COMPOSITION

The present invention relates to a grease composition, particularly a grease composition which gives reduced corrosion of metals in contact with the grease.

Many greases are oils which have been thickened by the addition to the oil of a gelling agent. The oils used for most greases are mineral oils, that is hydrocarbon oils, but other oils, such as synthetic oils, can be used to produce greases, for example synthetic hydrocarbon oils, diesters such as di(2-ethylhexyl) sebacate, perfluoroalkyl ethers and silicone oils. Many greases are obtained using soaps, generally lithium soaps, as the gelling agent. However, non-soap gelling agents can produce a grease having improved properties, for example such greases may be used at a higher continuous use temperature.

Non-soap gelling agents include clays, carbon black, silica and polyurea, all of which are preferably used as finely divided solid materials. Finely divided clay particles, for example clays of the bentonite or hectorite types, can be used as non-soap gelling agents to obtain grease from an oil such as a mineral oil. The clay particles are commonly used after being surface coated with an organic material such as a quaternary ammonium compound. In silicone oils, a silica filler may be used as a non-soap gelling agent, a typical silica for this purpose being fumed silica having an average particle size less than one micron.

In use many greases are in contact with metal bearing surfaces and the metal is frequently susceptible to corrosion. To reduce the corrosion of the metal, additives to provide corrosion protection may be added to the grease. However, greases containing non-soap gelling agents such as clays or silica can undergo de-structuring, by which is meant that the oil and gelling agent separate. Additives which are useful to provide corrosion protection can cause de-structuring of greases containing non-soap gelling agents. Sodium nitrite has been proposed as a corrosion inhibitor in non-soap thickened greases. However, many greases contain amine compounds as antioxidants and there is then a risk of carcinogenic nitrosoamines being formed and hence the use of sodium nitrite is undesirable. Disodium sebacate is used in non-soap thickened greases to provide some corrosion protection without promoting destructuring of the grease. However, this material is expensive and it is desirable to find alternative corrosion inhibitors which do not cause de-structuring of non-soap thickened greases.

We have now found certain metal salts of aromatic carboxylic acids provide useful inhibition of corrosion without causing de-structuring of a non-soap thickened grease.

According to the present invention there is provided a composition which comprises (a) a salt of a monovalent metal (M) of a carboxylic acid in which at least one carboxylic acid group is attached to a ring atom of a fused ring system; and (b) a grease which is a non-soap thickened mineral or synthetic oil.

Hereafter the salt of a monovalent metal (M) of a carboxylic acid in which the carboxylic acid group is attached to a ring atom of a fused ring system will be referred to simply as "the salt".

The fused ring system may be substituted or unsubstituted. Suitable substituents include halogen atoms, hydroxyl groups, hydrocarbyl groups, hydrocarbonoxy groups, hydrocarbonyl groups or hydrocarbonyloxy groups. Any substituent groups which are present in the fused ring system are additional to the carboxylic acid group or groups. The substituent groups may be such as to modify the solubility characteristics of the salt but preferably should not produce appreciable solubility in the oil on which the grease is based. Thus, the substituent may be an alkyl, alkenyl, alkoxy or acyl group preferably one which contains not more than 4 carbon atoms. Useful results have been obtained when the fused ring system contains at least one substituent group which is a hydroxyl group.

The fused ring system contains at least two rings fused together. One or more of the rings may contain a heteroatom, for example a nitrogen atom. Salts in accordance with the present invention are particularly those in which at least one ring of the fused ring system is a hydrocarbon ring. Convenient compounds are those in which the fused ring system is a hydrocarbon ring system, for example a fused aromatic hydrocarbon ring system. If the fused ring system contains a hydroxyl group substituent, it is preferred that the hydroxyl group and the carboxylic acid group are attached to adjacent carbon atoms of the fused ring system, and especially of a fused hydrocarbon ring system. The fused ring system is typically a naphthalene ring system, for example as in 2-naphthoic acid, 3-hydroxy-2-naphthoic acid, 2-hydroxy-1-naphthoic acid and 1-hydroxy-2-naphthoic acid.

The metal (M) is monovalent and is typically an alkali metal, for example lithium, potassium and especially sodium. We have obtained useful results using sodium 2-naphthoate and sodium 3-hydroxy-2-naphthoate. The salt is preferably finely divided and in general is sufficiently fine to pass through a sieve having a mesh spacing of not more than 100 micrometers.

The composition of the present invention also includes a grease. The grease may be based on a mineral oil and with such a grease the non-soap thickening agent is preferably a finely divided clay and especially an organophilic clay. Alternatively the grease may be based on a synthetic oil which may be a silicone oil such as a polydiorganosiloxane, for example a polydimethylsiloxane or copolymer thereof. A suitable thickening agent for such a grease is finely divided silica, particularly fumed silica.

Non-soap thickened greases in which the thickening agent is a clay, carbon black, silica or a polyurea are commercially available and the salt which is component (a) can be incorporated into such a grease to provide useful corrosion protection with no detectable de-structuring of the grease.

The composition of the present invention which comprises components (a) and (b) may include other materials as additives to the grease, in addition to the salt. These other materials may include those which have been proposed as corrosion inhibitors. However, it should be appreciated that the other materials should not themselves cause de-structuring of the grease and should not interact with the salt to cause destructuring of the grease. Whether or not destructuring of the grease occurs can be determined readily, for example by visual observation or by a comparatively simple test.

The composition typically contains from 0.1 to 30% by weight of the salt relative to the total volume of the composition and preferably the salt is present in an amount of o.1 to 5% w/v.

In addition to the metal salt, the composition of the present invention may include various other ingredients commonly incorporated into a grease such as oxidation inhibitors, and extreme pressure additives.

The composition of the present invention may be prepared using any of the techniques which are effective for incorporating solids into a liquid or plastic medium in which the solid is essentially insoluble. Satisfactory incorporation of the salt, preferably in finely divided form, into the grease may be achieved by mixing the salt and the preformed grease together, for example by stirring together for a few minutes, typically not more than 10 minutes. Alternatively the salt may be incorporated into the oil which is subsequently thickened to form the desired grease.

The grease composition of the present invention may be used in any application for which a grease is known, and in particular can be used in general automotive applications and also in bearings including high performance bearings. We have found that when subjected to an anti-rust test the compositions of the present invention show improved resistance to corrosion compared to a grease composition containing the same weight of the known corrosion inhibitor, disodium sebacate.

A bearing containing, as a lubricant, a grease composition in accordance with the present invention is a further feature of the present invention.

Various aspects of the present invention are set out in more detail hereafter in the following illustrative examples in which all parts and percentages are by weight unless otherwise stated.

Preparation of sodium salts

The sodium salts of 2-naphthoic acid and 3-hydroxy-2-naphthoic acid were prepared by neutralising the acid with an equivalent amount of aqueous sodium hydroxide solution to obtain a solution of the salt and evaporating the solution to dryness.

The salt obtained was crushed through a 300 mesh sieve (about 57 micrometers mesh spacing).

EXAMPLES 1 AND 2

Samples of an organo clay grease were applied to bearings which were then subjected to the IP dynamic anti-rust test for lubricating greases (IP 220) using distilled water. The grease had been obtained by thickening lubricating oil with 9% w/w of an organophilic clay and contained no corrosion inhibitor. The test was carried out using samples of the grease to which 1% w/w of a corrosion inhibitor had been added and also a grease to which there was no addition of a corrosion inhibitor. The corrosion inhibitors were used as fine solids and were incorporated into the grease by stirring in by hand.

On completion of the test after seven days, the bearings were removed, cleaned and the outer ring track carefully examined for rust or etch spots and rated in accordance with the standards of the test. The results obtained are set out in Table One.

TABLE ONE

| Example or Comp. Ex. | Additive Type (a) | Corrosion rating (b) |
|---|---|---|
| 1 | SB | 0 |
| 2 | SN | 0 |
| A | DSS | 2 |

TABLE ONE-continued

| Example or Comp. Ex. | Additive Type (a) | Corrosion rating (b) |
|---|---|---|
| B | Nil | 5 |

Notes to Table One
(a) SB is sodium 3-hydroxy-2-naphthoate.
SN is sodium 2-naphthoate.
DSS is disodium sebacate, a commercially available corrosion inhibitor.
Nil means that no corrosion inhibitor was added to the grease.
(b) The corrosion rating is assessed in accordance with IP 220 in which ratings are assigned, on a non-linear scale from zero (no visible corrosion) to five (an area of corrosion more than 10% of the surface).

Visual examination of the grease samples showed no obvious signs of de-structuring of the grease. Using a Bohlin rheometer in the oscillatory mode, the data obtained indicated that no appreciable de-structuring had occurred, the variation in the viscoelastic properties with shear being essentially the same in all the grease compositions tested, both with and without a corrosion inhibitor.

By way of contrast, when zinc 3-hydroxy-2-naphthoate was used, the EMCOR rating was 0 but de-structuring of the grease was apparent both from visual inspection and from tests using the Bohlin rheometer.

EXAMPLE 3

The procedure of Examples 1 and 2 was repeated using a grease obtained by thickening a silicone oil with about 8% w/w of finely divided silica.

The results obtained are set out in Table Two.

TABLE TWO

| Example or Comp. Ex. | Additive Type (a) | Corrosion rating (b) |
|---|---|---|
| 3 | SB | 0 |
| C | Nil | 5 |

Notes to Table Two
(a) and (b) are both as defined in Notes to Table One.

Examination of the grease, both by visual examination and by using the Bohlin rheometer indicated that no appreciable de-structuring had taken place.

EXAMPLES 4 AND 5

To samples of an organo-clay lubricating grease (prepared as described in Examples 1 and 2) were added 1% w/w of a corrosion inhibitor using the procedure described in Examples 1 and 2.

Samples of grease containing a corrosion inhibitor, and also samples of a grease containing no corrosion inhibitor, were subjected to the cone penetration of lubricating grease using one-half scale cone equipment and the procedure of ASTM Test Method D1403. The cone penetrations were carried out on samples of grease which had been brought to 25° C. and subjected to sixty double strokes in a grease worker in the manner described in ASTM Test Method D1403. Using the standard formula as set out in ASTM Test Method D1403, the measurements made were transformed to give the worked penetration of the cone for full scale cone equipment. The results obtained are set out in Table Three.

TABLE THREE

| Example or Comp. Ex. | Additive Type (a) | Worked Penetration (b) |
|---|---|---|
| 4 | SB | 327 |

TABLE THREE-continued

| Example or Comp. Ex. | Additive Type (a) | Worked Penetration (b) |
|---|---|---|
| 5 | SN | 327 |
| D | DSS | 331 |
| E | NIL | 320 |

Notes to Table Three (a) is as defined in Notes to Table One;

(b) Worked penetration is the depth, in tenths of a millimeter, that the standard cone penetrates the worked grease using the conditions as set out in ASTM Test Method D1403 and the standard formula to transform the measurements.

I claim:

1. A composition which comprises (a) a salt of a monovalent metal (M) of a carboxylic acid in which the carboxylic acid group is attached to a ring atom of a fused ring system; and (b) a grease which is a non-soap thickened mineral or synthetic oil.

2. The composition of claim 1 wherein component (a) is a salt in which the fused ring system is further substituted with at least one group which is a halogen atom, a hydroxyl group, a hydrocarbyl group, a hydrocarbonoxy group, a hydrocarbonyl group or a hydrocarbonyloxy group.

3. The composition of claim 2 wherein the further substituent in the fused ring is at least one hydroxyl group.

4. The composition of claim 1 wherein component (a) is a salt in which the fused ring system is a fused aromatic hydrocarbon ring system.

5. The composition of claim 1 wherein component (a) is a salt of an alkali metal.

6. The composition of claim 3 in which component (a) is a salt in which the hydroxyl group and the carboxylic acid group are attached to adjacent carbon atoms of the fused ring system.

7. The composition of claim 1 wherein component (a) is sodium 2-naphthoate or sodium 3.hydroxy-2-naphthoate.

8. The composition of claim 1 wherein the grease is a clay, carbon black, silica or polyurea thickened mineral or synthetic oil grease.

9. The composition of claim 8 wherein the grease is a mineral oil thickened with a finely divided clay.

10. The composition of claim 9 wherein the grease is a mineral oil thickened with an organophilic clay.

11. The composition of claim 8 wherein the grease is a non-soap thickened synthetic oil grease obtained from a synthetic hydrocarbon oil, a diester, a perfluoroalkyl ether or a silicone oil.

12. The composition of claim 11 wherein the grease is a silicone oil thickened with fumed silica.

13. The composition of claims 1 which contains 0.1 to 30% by weight of the salt which is component (a) relative to the total volume of the composition.

14. The composition of claim 13 which contains 0.1 to 5% by weight of the salt which is component (a).

15. A bearing containing as a lubricant the composition of claim 1.

* * * * *